US005105959A

United States Patent [19]

Kinsley

[11] Patent Number: 5,105,959

[45] Date of Patent: Apr. 21, 1992

[54] TAMPER-INDICATING DEVICE

[76] Inventor: John P. Kinsley, 740 Woodland Dr., Crystal Lakes, Ill. 60014

[21] Appl. No.: 614,010

[22] Filed: Nov. 13, 1990

[51] Int. Cl.[5] ..... B65D 51/00

[52] U.S. Cl. ..... 215/227; 215/230; 215/235

[58] Field of Search ..... 215/203, 230, 227

[56] References Cited

U.S. PATENT DOCUMENTS

| | | | |
|---|---|---|---|
| 4,127,221 | 11/1978 | Vere | 222/153 |
| 4,502,605 | 3/1985 | Wloszczyna | 215/230 |
| 4,595,123 | 6/1986 | Libit | 222/23 |
| 4,603,785 | 8/1986 | Gach | 215/230 |
| 4,711,372 | 12/1987 | Gach | 222/23 |
| 4,736,857 | 4/1988 | Monico, Jr. et al. | 215/230 |
| 4,747,497 | 5/1988 | Holman | 215/230 |
| 4,765,498 | 8/1988 | Rafferty | 215/230 |

*Primary Examiner*—Stephen Marcus
*Assistant Examiner*—Nova Stucker

[57] ABSTRACT

A tamper-indicating device is provided for use with two relatively movable parts. In a preferred embodiment, the device is incorporated in a tamper-evident closure having a closure body and a cover for engaging the body in a closed position. A resilient member is carried within the cover, and a releasable retaining structure is provided for holding the resilient member in a maximally deformed first orientation within the cover when the cover is in the closed position. When the cover is opened, the resilient member is released so as to assume a less deformed orientation. The cover includes an inspection means for permitting visual inspection of the released resilient member to indicate that the cover has been moved away from the initially closed position.

20 Claims, 3 Drawing Sheets

FIG. 1
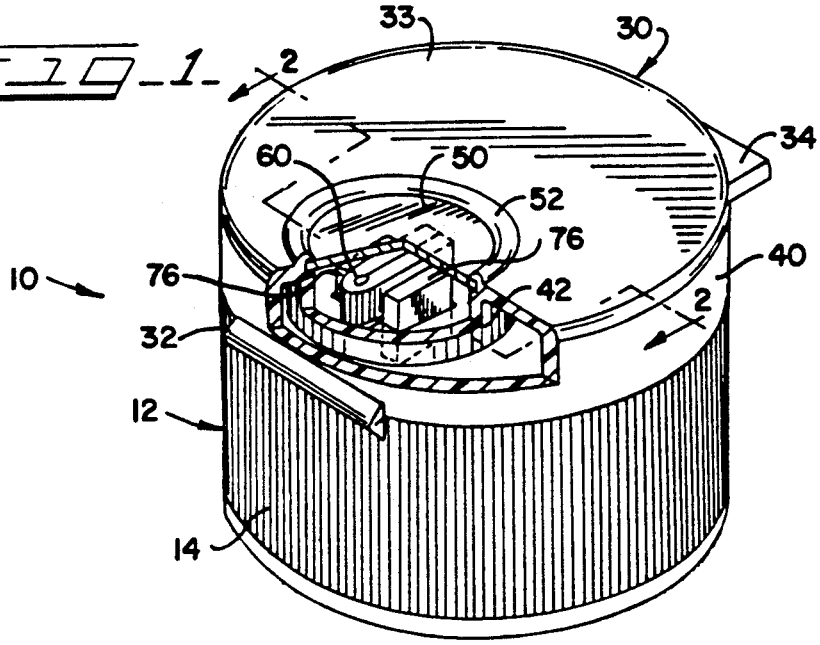
FIG. 2
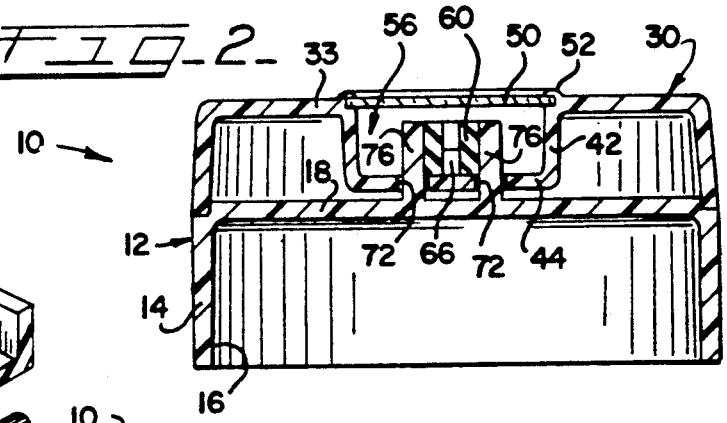
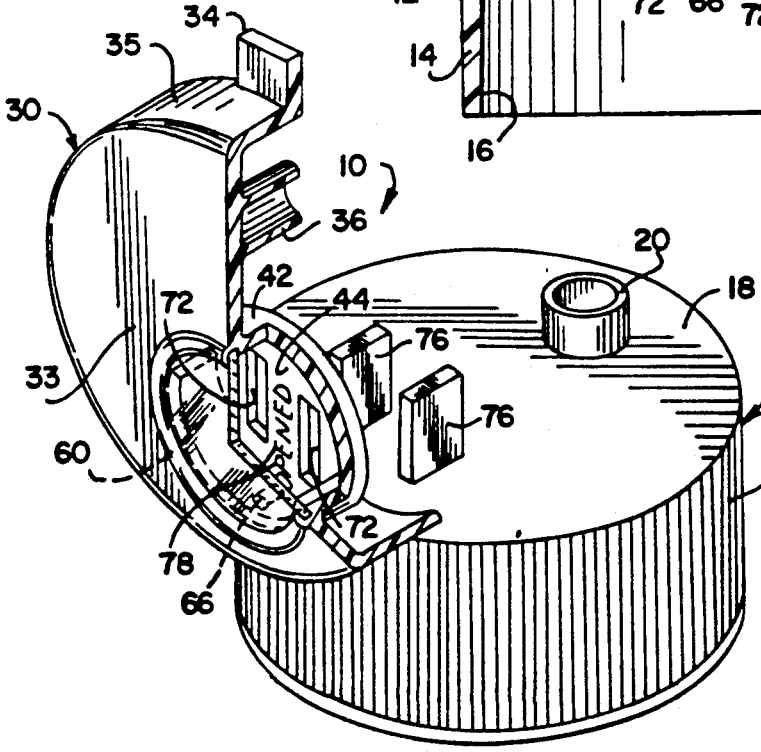
FIG. 3

TAMPER-INDICATING DEVICE

TECHNICAL FIELD

This invention relates to a tamper-indicating device for two relatively movable parts. The device is especially suitable for being incorporated in a closure for a container to provide evidence of a prior opening of the closure or tampering therewith.

BACKGROUND OF THE INVENTION AND TECHNICAL PROBLEMS POSED BY THE PRIOR ART

Tamper-indicating seals of various kinds have long been used in various applications (e.g., the ancient wax seal on an envelope or folded document and the lead seal on meters for measuring electric power use or water use).

A variety of designs have also been proposed for tamper-evident closures to give evidence that a container has been opened or has been placed in a condition for opening once it has been filled. Such tamper-evident closures are particularly useful for containers of liquids, powders, pills and the like which contain food materials, pharmaceutical materials, household chemical materials, personal health care materials, etc.

A number of designs for tamper-evident closures have received wide spread commercial use. Many such designs require that a portion of the closure or surrounding member be destroyed or torn away. For example, there are frangible collars or tear-away bands that are employed with closures, and when such a collar or band is torn away, the destruction of the collar or band is clearly evident. The closure can be opened only after that has occurred.

In another design, a plastic film or band is heat shrunk over the neck of the container and over a portion of the closure. This too must be torn away to enable the closure to be opened, and it provides evidence that the package integrity has been compromised.

Other closures employ metal foil sealed to the mouth of the container. Access to the container requires perforation or removal of the foil, and this clearly gives evidence of any prior attempt to open the container.

While many of the above-described types of closures function generally satisfactorily in particular applications for which they have been designed, they are not without certain disadvantages. For example, some consumers are frustrated with the difficulty of opening these types of closures. A degree of force may be required which is not possessed by all consumers, particularly the elderly and/or infirm.

Further, the types of tamper-evident closures which require materials to be torn away may result in the production of loose waste material requiring disposal.

Additionally, tamper-evident closures which incorporate barriers that must be destroyed in order to facilitate either opening of the closure or entry into the container necessarily impose on the consumer a time-consuming step which the consumer may find frustrating under certain circumstances.

It would be desireable to provide an improved tamper-indicating device that could be used in a variety of applications, especially in a closure. A closure with such an improved tamper-indicating device should advantageously minimize (1) the difficulty that some consumers may have in opening the closure, (2) minimize the creation of waste during the opening process, and, (3) minimize the amount of time required to open the closure.

Further, such an improved closure should also preferably function with conventional container designs so as to minimize the total cost of the package.

It would also be advantageous if such an improved closure could be designed for use with conventional closure-applying machines. Desirably, such an improved closure should require no modification to such conventional closure-applying machines and should be useable with a variety of conventional closure-applying machines as well as with a variety of conventional containers.

It would also be beneficial if such an improved closure could be opened with a normal opening manipulation requiring no special or additional steps. However, such an improved closure should also be difficult to subvert.

Additionally, it would be desireable to provide such an improved closure that can be fabricated relatively easily and that does not require any additional secondary steps during the application of the closure to the container or after application of the closure to the container.

Such an improved closure should also be capable of being molded from thermoplastic materials in a way that will permit the tamper-indicating feature to be customized, if desired, and in a way that will permit the tamper-indicating feature to be fitted to a wide range of closure sizes.

Finally, it would be desirable to provide the improved tamper-indicating device with a design that would readily accommodate employment in a wide variety of applications outside of the container closure field.

SUMMARY OF THE INVENTION

A tamper-indicating device is provided for relatively movable first and second parts. A resilient member is carried in the first part. A releasable retaining means is defined by the first and second parts for holding the resilient member in a maximally deformed first orientation in the first part when the first and second parts are in an initial relative position. One of the parts defines an inspection means for permitting visual inspection of the releasable retaining means at least when the first and second parts are in the initial position.

The resilient member is released in the first part to assume a less deformed orientation when the first and second parts are moved away from the initial relative position.

The novel tamper-indicating device can be incorporated in a closure for a container wherein the closure has two parts movable between an initially closed condition and an open condition. In a preferred form, the closure includes a body around the container opening, and the body may be a unitary part of the container or may be a separate member mounted to the container.

The closure further includes a cover for occluding the container opening in a closed position to engage the body and for being moved away from the closed position to permit the dispensing of the container-stored contents therefrom.

A resilient member is carried within the cover. The body and cover define a releasable retaining means for holding the resilient member in a maximally deformed first orientation in the cover when the cover is in the closed position and for releasing the resilient member in the cover to assume a less deformed orientation when the cover is moved away from the closed position. An inspection means is defined by the cover for permitting visual inspection of the releasable retaining means.

In a preferred embodiment, the releasable retaining means includes (1) upwardly projecting holding means defined by the body and (2) an engaging wall defined by the cover for receiving the holding means projecting therein and for engaging the resilient member when the cover is moved away from the closed position to thereby release the resilient member from the holding means.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a fragmentary, perspective view of a first embodiment of the tamper-indicating device of the present invention as incorporated in a closure shown in a closed position prior to installation on a container;

FIG. 2 is a cross-sectional view taken generally along plane 2—2 in FIG. 1;

FIG. 3 is a view similar to FIG. 1 but showing the lid in an opened position;

DESCRIPTION OF THE PREFERRED EMBODIMENTS

Figure 4:
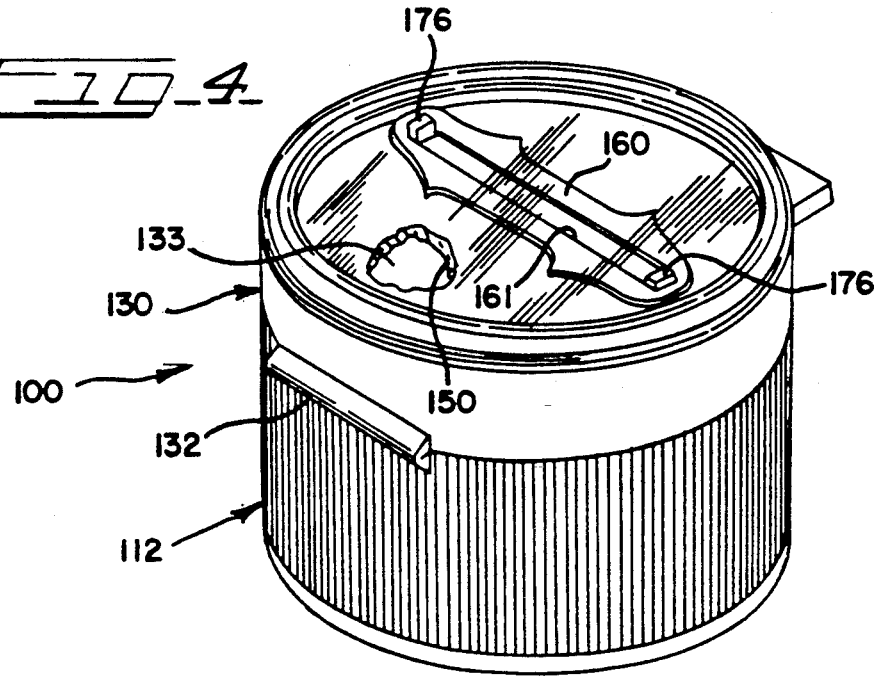
FIG. 4 is a fragmentary, perspective view of a second embodiment of the tamper-indicating device of the present invention as incorporated in a closure.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the tamper-indicating device of this invention is described in the normal (upright) operating position, and terms such as upper, lower, horizontal, etc., are used with reference to this position. It will be understood, however, that the tamper-indicating device of this invention may be manufactured, stored, transported, used, and sold in an orientation other than the position described.

The tamper-indicating device of this invention can be employed in a closure which may be applied to a container with conventional capping machines or with other tools and mechanisms, the details of which, although not fully illustrated or described, will be apparent to those having skill in the art and an understanding of the necessary functions of such machines, tools and mechanisms. The detailed descriptions of such machines, tools, and mechanisms are not necessary to an understanding of the invention and are not herein presented because such machines, tools, and mechanisms form no part of the present invention.

The closure employing the device of this invention may also be incorporated directly in the container as a unitary or integral part of the container. However, it is presently contemplated that the typical use of the closure of the present invention would be as a separate, pre-fabricated assembly for being subsequently applied to a container.

A first embodiment of the tamper-indicating device of the present invention as used in a closure is illustrated in FIGS. 1-3 wherein the closure is designated generally by the reference numeral 10. The closure 10 has a main body 12 for attachment around the opening of a container (not illustrated). The container may be a conventional bottle such a blown glass container or may be a plastic container such a blow-molded, high density polyethylene container.

The closure body 12 may be fabricated from a suitable thermoplastic material, such as high density polyethylene or polypropylene, by injection molding. The body 12 includes an annular skirt 14 which, in a preferred embodiment, is formed as a unitary part of the closure 12. The skirt 14 would typically include means for attaching the closure body 12 to cooperating attachment means on the container. Such attachment means, although not illustrated, may be of any suitable well-known configuration, such as snap-fit beads or helical threads. If threads are employed, then conventional or special one-way or anti-reverse structures are preferably employed to prevent removal of the closure body 12 from the container so as to inhibit attempts to defeat the tamper-indicating feature of the closure.

Preferably, however, the closure body skirt 14 defines a generally cylindrical inner surface 16 (FIG. 2) which is adapted to be securely fixed to the container by means of friction spin-welding, adhesive, staking, or other suitable or conventional or special procedures well-known to those of ordinary skill in the art. The details of such methods are not necessary to an understanding of the present invention and form no part of the present invention.

As best illustrated in FIGS. 2 and 3, the body 12 includes a generally horizontally extending top structure or deck 18 which closes over a major portion of the opening to the container (not illustrated) which is normally disposed below the closure deck 18 when the closure body 12 is properly assembled on the container. The deck 18 is provided with a dispensing aperture (not visible in the figures) and an upstanding, annular dispensing collar or spout 20 (FIG. 3) which surrounds the dispensing aperture.

The closure 10 also includes a cover or lid 30 which is adapted to overlie the closure body 12 in a closed position as illustrated in FIG. 1. Preferably, as illustrated in FIG. 1, the cover 30 is connected to closure body 12 by means of hinge 32. Typically, the hinge 32 may be provided in the form of a thermoplastic "living" hinge which accommodates pivoting movement of the cover 30 from the closed position illustrated in FIG. 1 to the open position illustrated in FIG. 3. It will be appreciated, however, that the present invention will accommodate the use of a cover which is completely separate, and removable, from the closure body 12.

The closure cover 30 has a preferred configuration defined by a generally horizontally extending top structure 33 and a downwardly depending, annular flange 35 from which a thumb tab 34 projects. The thumb tab 34 aids in lifting the cover 30 upwardly. The cover 30 also further includes a downwardly projecting plug member 36 for being received in, and occluding, the dispensing spout 20 on the closure body 12.

As best illustrated in FIGS. 1-3, the cover 30 includes a downwardly depending, annular retaining flange or wall 42 and a engaging structure, plate, or wall 44 which is generally perpendicular to the annular flange 42 and which closes off the lower end of the flange 42. When the cover 30 is in the closed position (FIG. 2), the engaging wall 44 is generally parallel to, and spaced slightly above, the deck 18 of the closure body 12.

A portion of the cover top structure 33 includes an inspection means or viewing port, such a transparent, disc-like window 50. The window 50 may be fabricated from a transparent thermoplastic material. In a preferred embodiment, such as that illustrated in FIGS. 1-3, the window 50 is retained in the top structure 33 by means of a deformed or swaged portion 52 of the top structure 33 which is deformed or crimped down over a top peripheral edge of the window 50. The window 50, annular flange 42, and bottom engaging wall 44 together define a cylindrical cavity 56 (FIG. 2) in which is disposed a resilient member 60.

In the preferred embodiment illustrated in FIGS. 1-3, the resilient member 60 is an elastic member which, in the initially assembled orientation shown in FIGS. 1 and 2, is folded over substantially in half with its bottom edge disposed on the engaging wall 44. Preferably, as illustrated in FIGS. 2 and 3, the cover 30 also includes a pin 66 projecting upwardly from the engaging wall 44. Initially, the resilient member 60 is folded in half substantially in a U-shaped configuration and inserted on the engaging wall 44 prior to installation of the transparent window 50) so that the pin 66 is on the inside of the fold. In FIG. 1, the pin 66 is not visible within the fold of the resilient member 60 because the height of the resilient member 60 is substantially greater than the height of the pin 66 as best seen in FIG. 2.

The engaging wall 44 defines a pair of spaced-apart apertures 72 as best illustrated in FIGS. 2 and 3 for accommodating tabs 76 which project upwardly from the deck 18 of the closure body. The tabs 76 are received in the cover apertures 72 when the cover is in the closed position as illustrated in FIGS. 1 and 2, but the apertures 72 are carried away from the tabs 76 when the cover 30 is moved away from the closed position to the open position as illustrated in FIG. 3.

The tabs 76 define a holding means for holding the resilient member 60 when the resilient member 60 is initially folded over and placed within the cover cavity 56 when the cover 30 is in the closed orientation. Together, the tabs 76 and the cover engaging wall 44 define a releasable retaining means for holding the resilient member 60 in a maximally deformed, first orientation (FIGS. 1 and 2) when the cover is in the closed position and for releasing the resilient member 60 to assume a less deformed orientation when the cover 30 is moved away from the closed position.

In particular, as the cover 30 is moved away from the closed position (FIG. 1) to the open position (FIG. 3), the engaging wall 44 moves the resilient member 60 out of the holding tabs 76 so that the resilient member assumes a less deformed second orientation. Specifically, and as shown in FIG. 3, the resilient member 60 unfolds and tends to straighten out in the cavity 56 against the cylindrical retaining wall 42. The resilient member 60 conforms to the curvature of the retaining wall 42 and is held generally against the wall 42 by the pin 66 which is spaced inwardly of the retaining wall 42 by an amount that is about equal to the thickness of the resilient member 60.

Preferably, the engaging wall 44 includes an indicium 78 (FIG. 3), such as the word "OPENED", and the indicium is located to be blocked from the viewer's vision by the resilient member 60 when the resilient member 60 is in the deformed first orientation. When the resilient member 60 is in the less deformed, second orientation (as illustrated in FIG. 3), the indicium becomes visible through the transparent window 50. This gives a positive and explicit indication that the cover 30 has been moved away from the fully closed position by an amount sufficient to disengage the resilient member 60 from the holding tab 76. This is evidence that the cover 30 has been moved from the initially closed orientation, and this may be an indication of tampering.

The resilient member 60 may be fabricated from a suitable material, such as elastic material. The resilient member may be a strip of natural or synthetic rubber or other material having sufficient resiliency to assume a less stressed configuration when it is released from holding means (e.g., tabs 76) that initially retains it in a first, more stressed configuration.

Figure 5:
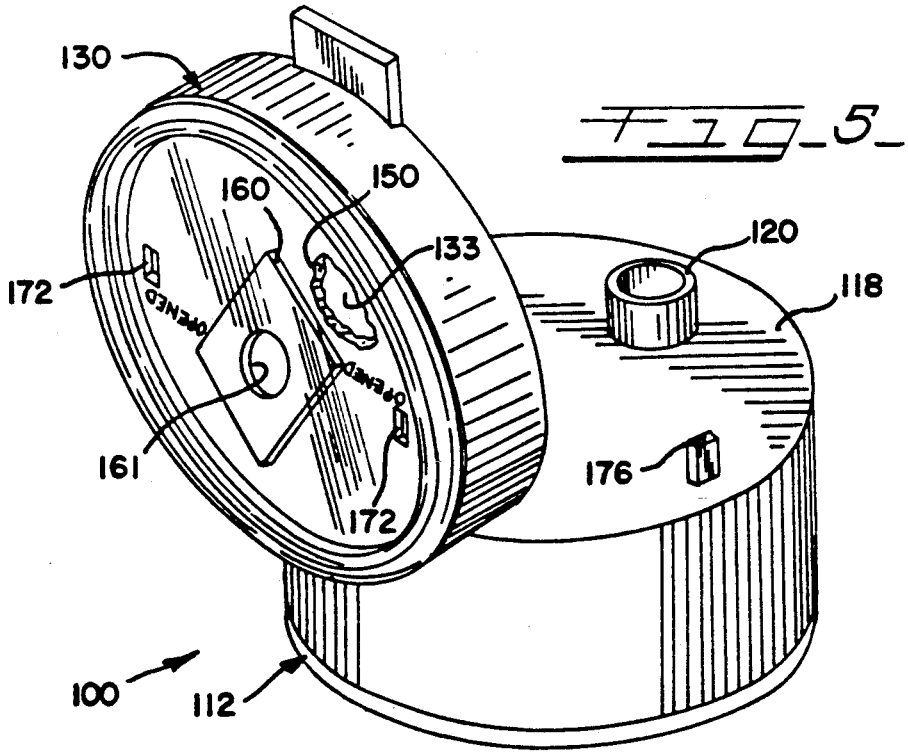
FIG. 5 is a view similar to FIG. 4 but showing the lid in an opened position.

A second embodiment of the tamper-indicting device of the present invention is illustrated in FIGS. 4 and 5 wherein the device is incorporated in a closure designated generally by the reference numeral 100. The closure 100 includes a body 112 and a cover 130. The cover 130 is hinged to the body 112 by means of a living hinge 132 (FIG. 4). The body includes a deck 118 defining a dispensing orifice (not visible in the figures) which is surrounded by an upwardly projecting dispensing spout 120 (FIG. 5).

The body 112 is adapted to be disposed at the end of a container (not illustrated) over the container opening. It may be an integral or unitary part of the container or may be attached to the container via snap-fit beads, threading, adhesive, etc. The second embodiment of the closure 100, as it has been described so far, can be substantially identical to the first embodiment of the closure 10 described above with reference to FIGS. 1-3.

However, unlike the first embodiment of the closure 10, the second embodiment of the closure 100 employs a different resilient member 160 and means for releasably retaining the resilient member 160 in the cover 130 when the cover is in the closed position (FIG. 4). Specifically, as illustrated in FIGS. 4 and 5, the closure body 112 includes two, upwardly projecting tabs 176 which are spaced relatively far apart compared with the tabs 76 of the first embodiment illustrated in FIGS. 1-3. The cover 130 defines an engaging member or wall 133 defining a pair of spaced-apart receiving apertures 172 (FIG. 5) through which the tabs 176 project when the cover 130 is in the closed position. A transparent, disc-like window 150 is disposed above, and is parallel to, the engaging wall or member 133.

The resilient member 160 is provided in the form of a piece of elastic having a ring-like configuration or having at least an aperture 161. The resilient member 160 is initially assembled on the closure before the transparent window 150 is installed on the cover 130. The resilient member 160 is stretched so that it can be engaged around the spaced-apart tabs 176 as illustrated in FIG. 4. The transparent window 150 may then be mounted on the closure cover 130 by suitable conventional or special means. For example, an annular peripheral portion of the cover 130 may be deformed over a peripheral portion of the window 150 or the window 150 may be secured by an adhesive or heat-sealing means.

When the closure is first opened, the engaging wall 133 carries the resilient member 160 upwardly and off the tabs 176. The resilient member 160 then assumes its normal, substantially unstressed configuration (as illustrated in FIG. 5). This gives an indication that the cover 130 was initially moved away from the fully closed position.

Preferably, the upwardly facing surface of the engaging wall 133 is provided with indicia located underneath the resilient member 160 when the member 160 is in the initial, stretched configuration (FIG. 4). The indicia may include the word "OPENED" printed at two locations—at a first location near one of the apertures 172 and at a second location near the other of the apertures 172.

The words "OPENED" are spaced relatively far apart, and the relaxed, unstressed size of the resilient member 60 is sufficiently small so that at least one of the words "OPENED" is completely visible after the cover 130 has been opened—regardless of the position of the resilient member 160. Since the resilient member 160 is free to slide around within the cover 130 after it has been opened, the resilient member 160 could overlie any portion of the engaging wall 133. Thus, the two words "OPENED" are spaced apart by a distance at least equal to the maximum width of the relaxed resilient member 160 so that if the resilient member 160 becomes positioned on the middle portion of the engaging wall 133, no part of the resilient member 160 will overlie either of the words "OPENED". However, should the engaging member 160 be moved to the left or to the right, then, although one of the "OPENED" terms may be partially or wholly covered by the resilient member 160, the other "OPENED" term will still remain completely exposed and visible through the transparent window 150.

It will be appreciated that the novel tamper-indicating device of the present invention provides a non-destructive tamper-evident feature that involves nothing more than the conventional or normal opening sequence for a hinged or removable lid.

The novel device may be employed in closures for conventional containers without requiring additional attachments or special finishes.

The closure is relatively easy to mold, and the closure can be fitted to all sizes of containers.

The tamper-indicating feature of the closure does not provide an obstacle or barrier to entry, and the use of the closure does not result in the creation of loose parts requiring disposal.

The tamper-evident feature is incorporated during the manufacture of the closure and does not require a special assembly step or additional manufacturing step at the point where the closure is applied to the container. This means that conventional closure applying techniques may be employed. However, the closure can be applied to containers in a variety of ways and may even be formed as part of the container if desired.

Figure 6:
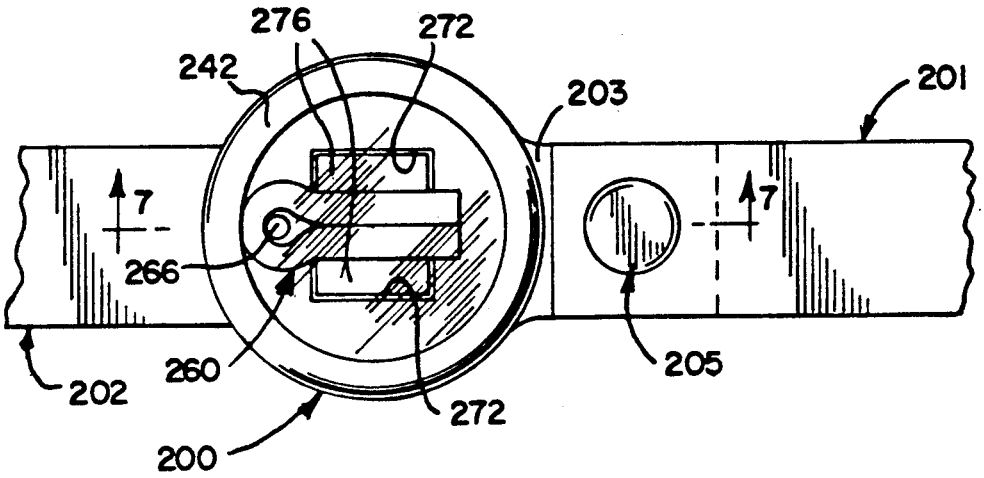
FIG. 6 is a fragmentary, plan view of a third embodiment of the tamper-indicating device of the present invention as incorporated in a strap system.
Figure 7:
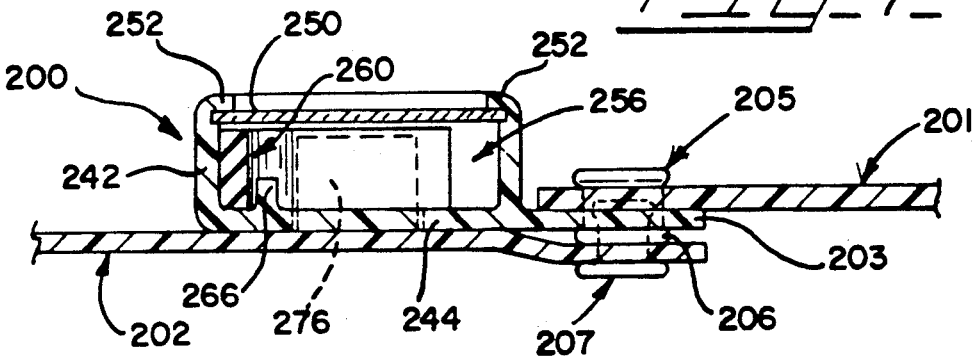
FIG. 7 is a fragmentary, cross-sectional view taken generally along the plane 7—7 in FIG. 6.
Figure 8:
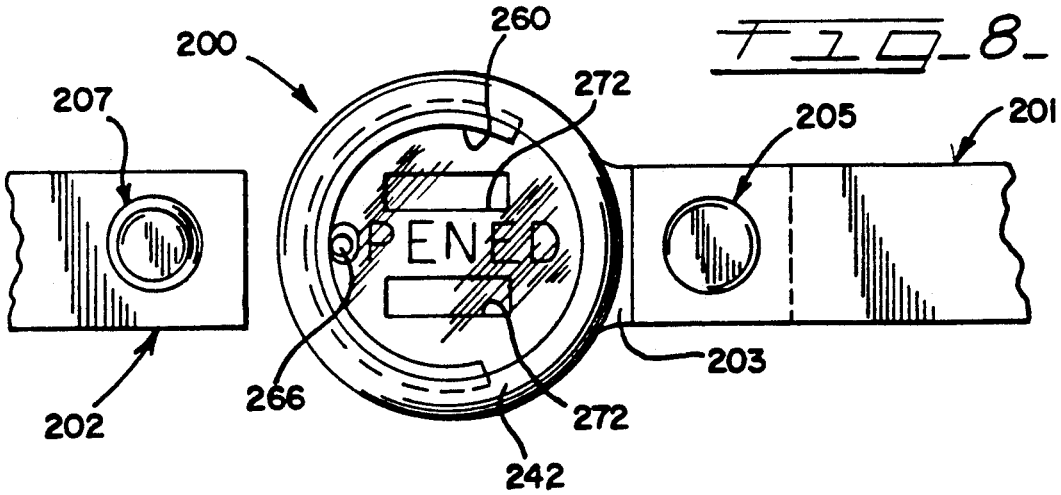
FIG. 8 is a view similar to FIG. 6 but showing the strap system disconnected and showing the tamper-indicating device in the opened condition.

A third embodiment of tamper-indicating device is illustrated in FIGS. 6–8 wherein the device is designated generally by reference numeral 200, and where the device 200 is incorporated in a strap system having strap ends 201 and 202. The strap ends 201 and 202 may be part of a single length of strap adapted for being formed in a loop about an object and connected at its ends 201 and 202. Alternatively, the strap ends 201 and 202 may be portions of completely separate straps used in securing or retaining an object.

The tamper-indicating device 200 may be fabricated from a thermoplastic material and provided with an extending mounting flange 203 which is permanently attached to the strap end 201 by, for example, a rivet-like snap member 205. The snap member 205 projects through both the strap end 201 and the device flange 203 so as to present a female-receiving flange structure 206 below the strap end 201. The structure 206 is adapted to receive a conventional male snap member structure 207 (FIG. 8) which is similarly attached permanently to the other strap end 202.

Typically, the snap members 205 and 207 would be snapped together by the manufacturer during the final assembly of the tamper-indicating device 200 which would result in the strap ends 201 and 202 carrying the tamper-indicating device 200 in a first "armed" orientation indicating that the strap ends 201 and 202 have not been opened.

The tamper-indicating device 200 is similar to the first embodiment of the device illustrated in FIGS. 1–3. The device 200 includes an annular retaining flange or wall 242 and an engaging structure, plate, or wall 244 which is generally perpendicular to the annular flange 242 and which closes off the lower end of the flange 242.

The device 200 further includes an inspection means or viewing port, such as a transparent, disc-like window 250. The window 250 may be fabricated from a transparent thermoplastic material and retained in the top of the flange 242 by means of a groove or swaged portion 252 which is deformed or crimped down over the top peripheral edge of the window 250. The window 250, annular flange 242, and bottom engaging wall 244 together define a cylindrical cavity 256 in which is a disposed a resilient member 260.

The resilient member 260 is an elastic member which, in the initially assembled orientation shown in FIGS. 6 and 7, is folded over substantially in half with its bottom edge disposed on the engaging wall 244. Preferably, as illustrated in FIGS. 6 and 7, the device 200 also includes a pin 266 projecting outwardly from the engaging wall 244. The resilient member 260 is folded around the pin 266 which serves to hold the middle portion of the resilient member 260 against the annular retaining flange or wall 242.

As best illustrated in FIG. 8, the engaging wall 244 defines a pair spaced-apart apertures 272. These apertures accommodate tabs 276 which project upwardly from the strap end 202. The strap end 202 may be fabricated from a thermoplastic material, and the tabs 276 may be molded as a unitary part of the strap 202. Alternatively, the tabs 276 may be separately fabricated as part of a sleeve (not illustrated) which can be crimped around the strap end 202.

The tabs 276 define a holding means for holding the resilient member 260 in the same manner as the tabs 76 discussed above for the first embodiment with reference to FIGS. 1–3.

When the strap ends 201 and 202 are unsnapped and separated, the tamper-indicating device engaging wall 244 necessarily retains the resilient member 260 within the cavity 256 as the tabs 276 separate from the cavity 256. The resilient member 260 is then free to assume a less deformed orientation illustrated in FIG. 8 to provide an indication that the device 200 has been moved from the initially closed orientation.

Together, the tabs 276 and the engaging wall 244 can be characterized as defining a releasable retaining means for holding the resilient 260 in the maximally deformed, first orientation (FIGS. 6 and 7) when the strap ends 201 and 202 are in the initially attached position and for releasing the resilient member 260 to assume a less deformed orientation when the strap ends 201 and 202 are moved away from the initial, attached position.

It will be readily observed from the foregoing detailed description of the invention and from the illustrated embodiments thereof that numerous other variations and modifications may be effected without departing from the true spirit and scope of the novel concepts or principles of this invention.

What is claimed is:

1. A tamper-indicating device incorporated in a closure for an opening into a container, said closure comprising:

a body for attachment around said container opening;

a cover movable between (1) a closed position engaged with said body for occluding said container opening and (2) an open position permitting the dispensing of container-stored contents therefrom;

a resilient member disposed in said cover in a deformed first orientation, said cover defining a cavity for initially receiving said resilient member in said deformed first orientation and for subsequently accommodating said resilient member in a less deformed second orientation, said cover further defining a window permitting visual inspection of said cavity;

holding means defined by said body and projecting upwardly into said cover cavity when said cover is in said closed position for initially holding said resilient member in said deformed first orientation; and engaging wall means defined by said cover for engaging said resilient member in said cavity and for accommodating the projection of said body holding means into said cavity whereby, when said cover is moved away from said closed position, said engaging wall moves said resilient member out of said holding means so that said resilient member assumes said less deformed second orientation to indicate that said closure has been opened.

2. The device in a closure in accordance with claim 1 in which said body is a member which is separate from, but which is adapted to be mounted to, said container.

3. The device in a closure in accordance with claim 1 in which said body is defined as a unitary portion of said container.

4. A tamper-indicating device incorporated in a closure for an opening into a container interior, said closure comprising:

a body for attachment around said container opening;

a cover for occluding said container opening in a closed position to engage said body and for being moved away from said closed position to permit the dispensing of container-stored contents therefrom;

a resilient member carried within said cover;

holding means defined by said body for holding said resilient member in a maximally deformed orientation when said cover is in said closed position;

a window defined by said cover to permit visual inspection of said resilient member; and engaging means defined by said cover for engaging said resilient member whereby, when said cover is moved away from said closed position, said engaging means moves said resilient member out of said holding means so that said resilient member assumes a less deformed orientation to indicate that said closure has been opened.

5. A tamper-indicating device incorporated in a closure for an opening into a container, said closure comprising:

a body adapted to be disposed at said container opening;

a cover for engaging said body in a closed position to occlude said opening and movable away from said closed position so that said opening is not occluded;

a resilient member carried within said cover;

releasable retaining means defined by said body and cover for holding said resilient member in a maximally deformed first orientation in said cover when said cover is in said closed position and for releasing said resilient member in said cover to assume a less deformed orientation when said cover is moved away from said closed position; and inspection means defined by said cover for permitting visual inspection of said releasable retaining means.

6. The device in a closure in accordance with claim 5 in which said releasable retaining means includes (1) upwardly projecting holding means defined by said body and (2) an engaging wall defined by said cover for receiving said holding means projecting therein and for engaging said resilient member when said cover is moved away from said closed position to thereby release said resilient member from said holding means.

7. The device in a closure in accordance with claim 6 in which said holding means includes a pair of upwardly projecting tabs.

8. The device in a closure in accordance with claim 7 in which said resilient member is an elastic ring stretched around said tabs so as to assume said deformed first orientation.

9. The device in a closure in accordance with claim 7 in which said resilient member is an elastic member which is folded over and retained between said tabs in said deformed first orientation.

10. The device in a closure in accordance with claim 9 further including a retaining wall defined by said cover and a retaining pin carried by said cover in spaced a relationship from said retaining wall so as to be located adjacent said tabs when the cover is in said closed position, said elastic member being folded generally in half around said pin whereby, when said cover is moved away from said closed position, said elastic member is released from said holding means tabs but is retained between said pin and retaining wall.

11. The device in a closure in accordance with claim 5 in which said cover includes an indicium which is located to be blocked from the viewer's vision by said resilient member in said deformed first orientation but which is visible when said resilient member assumes said less deformed orientation.

12. The device in a closure in accordance with claim 5 and further including said container in combination with said closure.

13. The device in a closure in accordance with claim 12 in which said closure body is disposed at an end of said container.

14. The device in a closure in accordance with claim 13 in which said closure body is a separate member mounted to said container.

15. The device in a closure in accordance with claim 13 in which said closure body is unitary with said container.

16. The device in a closure in accordance with claim 7 in which said engaging wall defines a pair of spaced-apart apertures through which said tabs project when said cover is in said closed position.

17. A tamper-indicating device for relatively movable first and second parts, said device comprising:

a resilient member carried by and in said first part;

releasable retaining means defined by at least said second part for engaging said resilient member and holding said resilient member in a maximally deformed first orientation in said first part when said first and second parts are in an initial relative position and for releasing said resilient member in said first part to assume a less deformed orientation within said first part when said first and second parts are moved away from said initial relative position; and inspection means defined by one of said first and second parts for permitting visual inspection of said releasable retaining means at least when said first and second parts are in the initial position.

18. A tamper-indicating device for relatively movable first and second parts, said device comprising:

a resilient member carried in said first part;

releasable retaining means defined by said first and second parts for holding said resilient member in a maximally deformed first orientation in said first part when said first and second parts are in an initial relative position and for releasing said resilient member in said first part to assume a less deformed orientation when said first and second parts are moved away from said initial relative position, said releasable retaining means including (1) projecting holding means defined by said second part and (2) an engaging member defined by said first part for receiving said holding means projecting therethrough and for engaging said resilient member when said first and second parts are moved away from said initial position to thereby release said resilient member from said holding means; and inspection means defined by one of said first and second parts for permitting visual inspection of said releasable retaining means at least when said first and second parts are in the initial position.

19. The device in accordance with claim 18 in which said holding means includes a pair of projecting tabs and in which said engaging member is a plate defining a pair of apertures for each receiving one of said tabs projecting therethrough.

20. The device in accordance with claim 19 in which said device is employed with the releasably attached strap ends defining said first and second parts, said tabs being fixed to one of said strap ends, and said plate being fixed to the other of said strap ends.

* * * * *